United States Patent [19]

Burley

[11] Patent Number: 4,632,329

[45] Date of Patent: Dec. 30, 1986

[54] THERMAL BARRIER DEVICE FOR WINTER RECREATION SURFACES

[76] Inventor: William G. Burley, Peterson Dr., Johnstown, Pa. 15905

[21] Appl. No.: 763,895

[22] Filed: Aug. 9, 1985

Related U.S. Application Data

[63] Continuation of Ser. No. 538,432, Oct. 3, 1983, abandoned.

[51] Int. Cl.[4] ..... B65H 16/00; B65H 75/40

[52] U.S. Cl. ..... 242/86.52; 52/3; 150/52 R; 24/442; 273/27; 62/235; 104/136; 242/74

[58] Field of Search ..... 242/55, 86.52, 86.5 R, 242/74; 272/3; 273/27; 62/235; 47/28 R; 150/52 R; 4/502, 503, 501; 5/483, 496; 52/3–5; 404/17, 72; 104/136; 24/442, 446

[56] References Cited

U.S. PATENT DOCUMENTS

| | | | |
|---|---|---|---|
| 1,576,888 | 3/1926 | Woodward | 273/27 |
| 3,202,193 | 8/1965 | Ware | 150/52 R |
| 3,948,457 | 4/1976 | Spreitzer | 242/74 |
| 4,050,972 | 9/1977 | Cardinal, Jr. | 242/86.52 |
| 4,094,021 | 6/1978 | Rapp | 4/503 |
| 4,118,012 | 10/1978 | Kerr et al. | 254/273 X |
| 4,197,595 | 4/1980 | Dearing | 4/503 |
| 4,281,802 | 8/1981 | Burley | 242/86.52 |
| 4,454,999 | 6/1984 | Woodruff | 242/86.5 R |
| 4,470,404 | 9/1984 | Kremen | 4/502 X |

FOREIGN PATENT DOCUMENTS

| | | | |
|---|---|---|---|
| 2939301 | 4/1981 | Fed. Rep. of Germany | 52/3 |

*Primary Examiner*—John M. Jillions

*Attorney, Agent, or Firm*—Fidelman, Wolffe & Waldron

[57] ABSTRACT

A thermal barrier device provides a heat insulative cover having low to negligible permeability to water vapor and a remote controlled reeling and unreeling mechanism for deploying and harvesting the cover onto and off of the exposed surfaces of ice rinks, curling rinks, ski jumps, toboggan runs, and the like. The length and width required for covering a particular exposed surface is readily adjustable by lengthwise and edgewise coupling means.

10 Claims, 13 Drawing Figures

Fig. 3
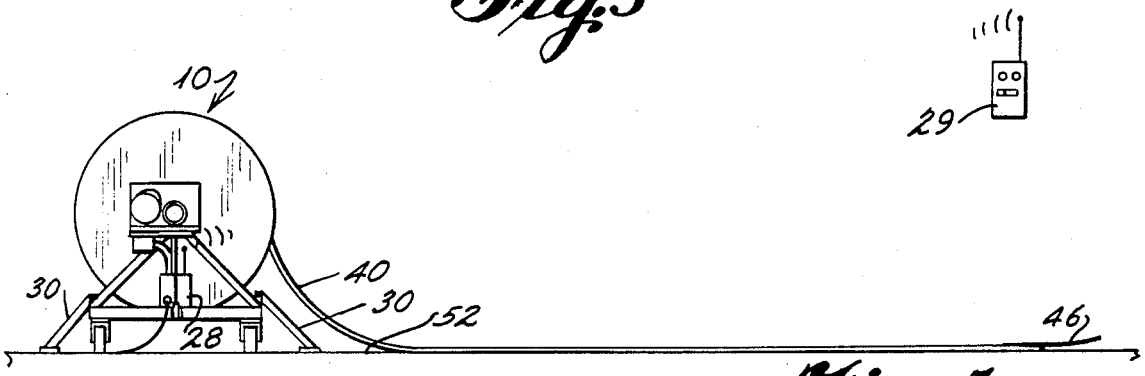
Fig. 5
Fig. 4
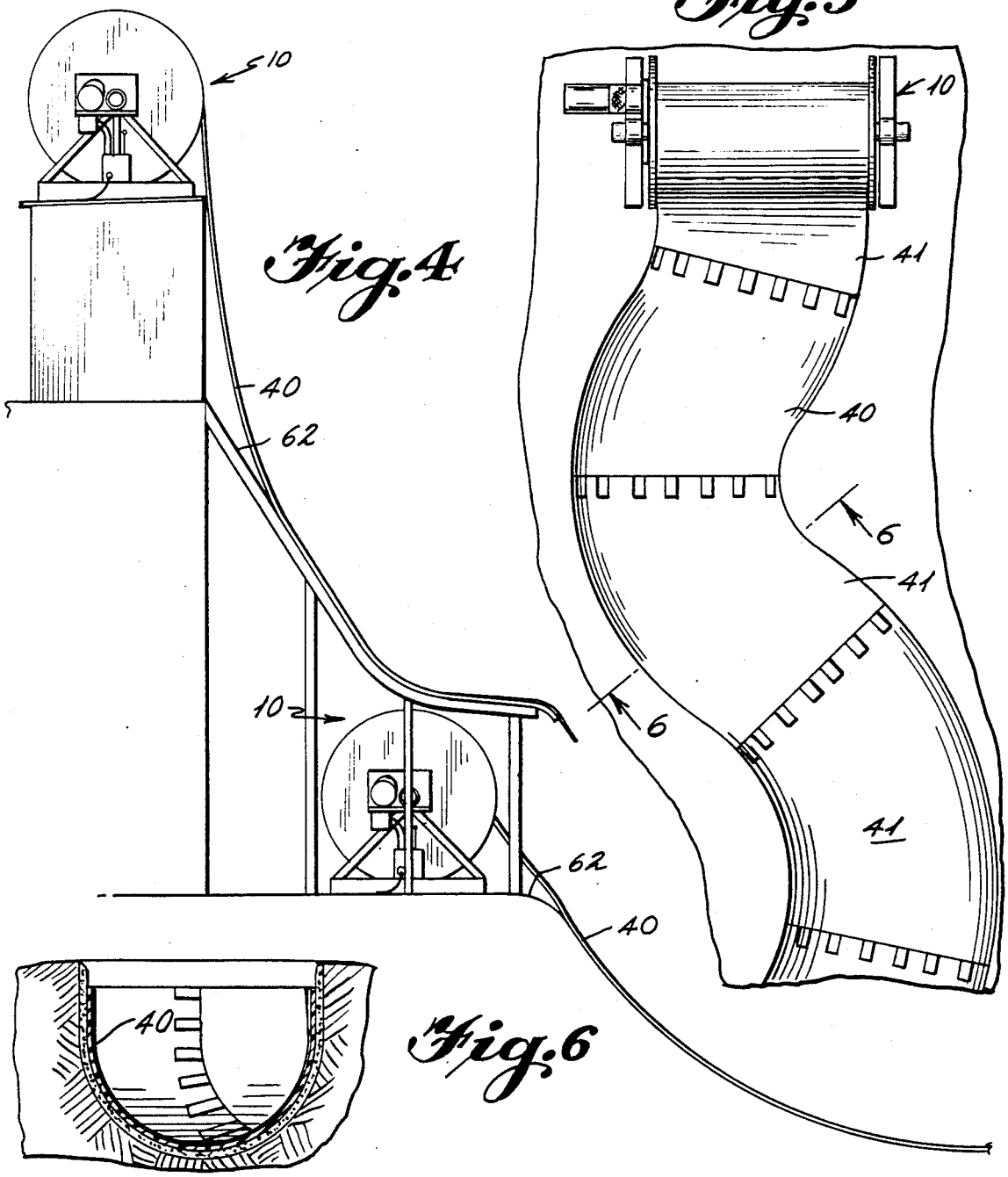
Fig. 6

THERMAL BARRIER DEVICE FOR WINTER RECREATION SURFACES

This application is a continuation, of application Ser. No. 538,432, filed 10/03/83, now abandoned.

CROSS-REFERENCES TO THE PRIOR ART

U.S. Pat. No. 3,108,804—APPARATUS FOR COVERING ATHLETIC FIELDS, issued Oct. 29, 1963.

U.S. Pat. No. 3,300,211—REMOVABLE SURFACE COVERINGS, issued Jan. 24, 1967.

U.S. Pat. No. 3,395,918—STORAGE DEVICE AND OPERATING MECHANISM FOR A TARPAULIN FOR THE PROTECTION OF A PLAYING FIELD, issued Aug. 6, 1968.

U.S. Pat. No. 3,782,663—ARTIFICIAL ROLL-UP FIELD, issued Jan. 1, 1974.

U.S. Pat. No. 3,863,387—GROUND PROTECTION COVERS, issued Feb. 4, 1975.

U.S. Pat. No. 3,983,713—METHOD OF CREATING AN OUTDOOR ICE SLAB IN SUMMER WEATHER AND OF REDUCING ENERGY REQUIREMENTS FOR INDOOR AND OUTDOOR ICE RINKS, issued Oct. 5, 1976.

U.S. Pat. No. 4,050,972—LAYING DOWN OF LARGE SHEETS OF FILM, issued Sept. 27, 1977.

U.S. Pat. No. 4,084,763—MACHINE FOR HANDLING ARTIFICIAL TURF OR THE LIKE, issued April 18, 1978.

U.S. Pat. No. 4,137,575—SWIMMING POOL TARPAULIN, issued Feb. 6, 1979.

U.S. Pat. No. 4,281,802—THERMAL ICE CAP, issued Aug. 4, 1981.

BACKGROUND OF THE INVENTION

The invention relates to improvements in a thermal barrier device for reducing heat transfer to and from the exposed surface of an ice rink, as disclosed in U.S. Pat. No. 4,281,802—Burley, Issued Aug. 4, 1981. The improved thermal barrier device disclosed herein allows guiding of a heat insulative vapor barrier onto and off of an exposed winter sport surface by a single operator having remote, radio control over the drive for a reeling and unreeling mechanism of the thermal barrier device.

The above cross-referenced prior art relates to covers for sports surfaces and to methods and apparatus for deploying and harvesting such surfaces. Of these, U.S. Pat. No. 3,863,387 discloses a translucent ground protection cover for a golf course; U.S. Pat. No. 4,137,575 discloses a floating, thermal insulative swimming pool cover; and U.S. Pat. No. 3,983,713 discloses a ceiling structure utilized with an indoor or outdoor ice rink to reduce the heat load on the ice surface. However, the prior art most pertinent to the instant application is that of U.S. Pat. No. 4,281,802, the disclosure of which is incorporated herein by reference.

U.S. Pat. No. 4,281,802 discloses a thermal insulative cover for an ice rink and motor driven reel for use in deploying and harvesting the cover. The cover is folded in half lengthwise and wound upon a reel so that, after deployment of the folded cover onto the ice surface, the cover may be unfolded to cover approximately one-half (½) of a nominally 17,000 square foot ice rink. In order to deploy and harvest the folded cover, reel connectors are disclosed as provided substantially mid-length of the cover so that opposite ends of the cover are deployable and harvestable simultaneously during the unwinding and winding of the reel.

In attempting to implement the method and apparatus disclosed in U.S. Pat. No. 4,281,802, it was found that the weight of the insulative material, which readily submits to the friction-free ice surface and subordinates itself almost completely on the ice during winding and unwinding in the folded condition, becomes prohibitive when attempting to lift it during folding and unfolding. In fact, three men tried in vain to fold a cover during harvesting, evidencing the failings and impracticalities of such an arrangement. Accordingly, the instant invention was developed in order to facilitate the use and handling of a thermal insulative cover which is equally adaptable to covering the exposed surfaces of ice rinks, ski jumps, curling rinks, luge runs, bobsled runs, and toboggan runs.

BRIEF SUMMARY OF THE INVENTION

By means of the instant invention, plural lengthwise sections of thermal insulative material are connectable and disconnectable heel-to-toe, without the need for folding of such a cover, such that deploying and harvesting such a cover may be accomplished by one operator who is able to guide each section as it is being reeled or unreeled onto a spool from the free end of a section while controlling drive of the reel by a remote, radio control, thus preventing bunching up of the edges of a secton with the end flanges of the spool.

BRIEF DESCRIPTION OF THE DRAWINGS.

FIG. 3 is a side elevation of the thermal barrier device during deployment or harvesting of the cover.

FIG. 4 is a schematic view illustrating use of the thermal barrier device with a ski jump area.

FIG. 5 illustrates use of the thermal barrier device on a luge, bobsled, or toboggan run.

FIG. 6 is a cross-section, as generally viewed in the direction of arrows 6—6 of FIG. 5, illustrating conformation of the insulative cover to the curvature of the run.

DETAILED DESCRIPTION OF THE INVENTION

Winter sport surfaces such as ice skating rinks, curling rinks, ski jumps, and the runs for bobsleds, luges, and toboggans are insulated during non-use by placing a thermal cover thereupon. The cover comprises at least one section of flexible material having thermal insulating properties and a very low water vapor transmission rate. The cover is deployable upon and harvestable from the winter sport surface by a single operator using a remote, radio controlled drive for a vehicle-mounted reel. In one embodiment of the invention, the cover comprises a series of sections detachably connected end-to-end such that several attached sections may be accomodated upon a single reel. The cover and reel have been provided with specific improvements over the prior art in order to overcome the difficulties, if not impossibilities, of manipulation of prior art covers.

Figure 1:
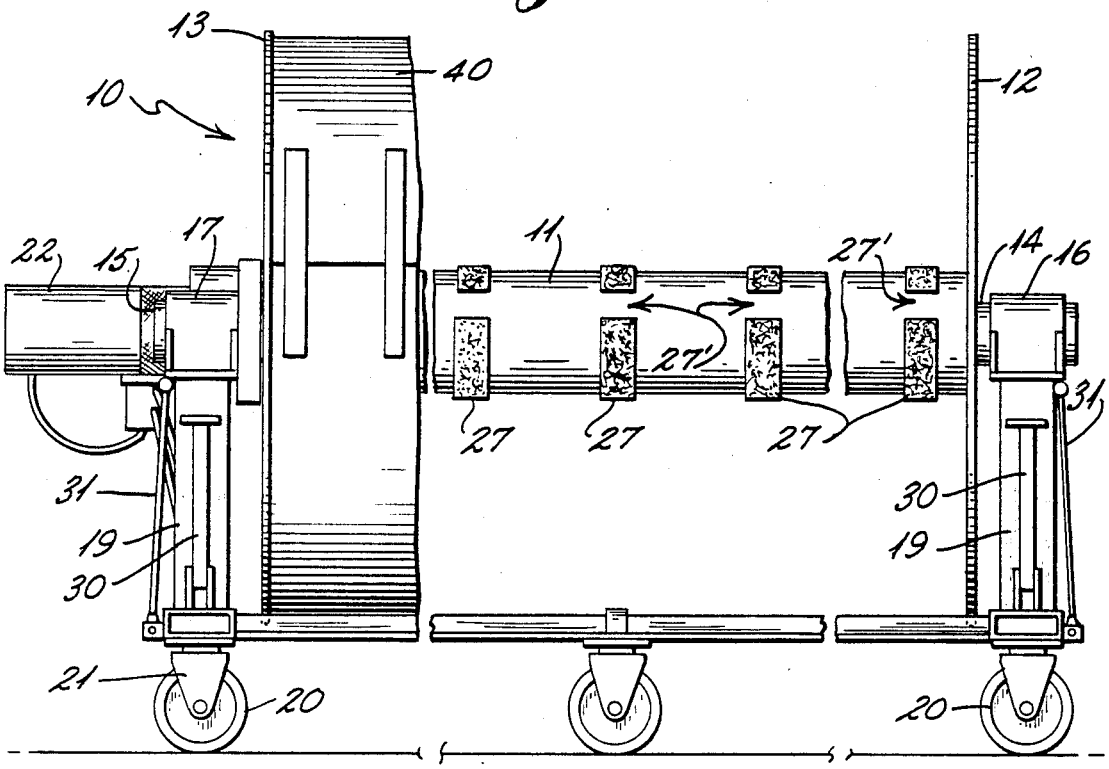
FIG. 1 is a plan view of a vehicle and powered reel for storing, unreeling and reeling the thermal cover.
Figure 2:
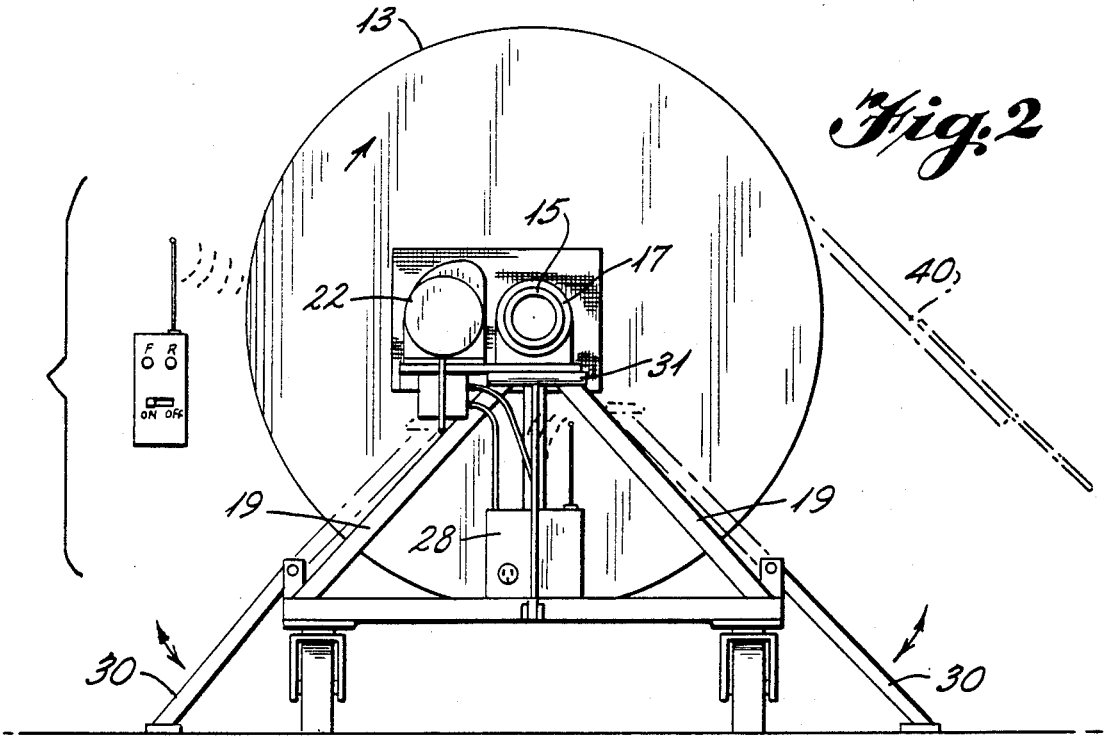
FIG. 2 is a left side elevation of the device of FIG. 1.

FIGS. 1 and 2 illustrate the improved reel for deploying and harvesting the thermal cover from a winter sport surface, particularly the skating surface of an ice rink. Reel 10 comprises an elongated spool 11 disposed axially between a pair of reel end plates 12 and 13. Axle means 14 and 15 extend outwardly from the reel ends and are journaled in bearings 16 and 17. The reel is supported in a horizontal rotatable position by a plurality of leg members 18 and 19 extending downwardly from the bearing housing or other suitable support points. Castors or wheels 20, which may be mounted in swivel frames 21, are mounted at the lower end of each leg member to provide a vehicle by means of which the reel is movable and positionable. A reversible electric motor 22 is supported to drive spool 11 rotatably via gears, pulleys and belt, or sprockets and chain. The above described features of the reel are disclosed in U.S. Pat. No. 4,281,802.

Improvements to reel 10, over the features disclosed in U.S. Pat. No. 4,281,802, comprise a remote control, such as a radio receiver 28 mounted upon the vehicular reel and radio transmitter 29 which may be carried by an operator during deploying and harvesting of the thermal cover as explained hereinafter. Other improvements in the reel include ice brakes 30, guiding handles 31, and VELCRO strips 27 on spool 11 for mating with VELCRO strips on the end of a section to be wound upon the reel.

FIG. 3 generally depicts the thermal cover and reel during deploying or harvesting thereof. As may be seen by reference to FIG. 3, reel 10 has been wheeled onto ice surface 52 and locked in position thereon by means of ice brakes 30, while cover 40 is deployed from reel 10 via remote control receiver 28 and transmitter 29. Although radio control is preferred, it is contemplated also that receiver 28 and transmitter 29 may be connected by electrical cables.

Various problems were encountered in attempting to implement the disclosure of U.S. Pat. No. 4,281,802. Among these, it was found that reel 10 was subject to sliding on the ice surface, especially during initial harvesting of a cover therefrom, even though wheels 20 have conventional wheel brakes applied thereto. Further, in attempting to reel a cover 40 onto a spool 11, it was found necessary to manipulate either the cover 40 or the reel 10 in order to prevent bunching up of at least one edge of the cover 40 against spool flanges or end plates 12, 13 during winding thereof. Such manipulation was found to require at least two or three workmen. Still further, proper reeling and unreeling of the cover required that an operator remain with the reel 10 in order to activate and deactivate a reel-drive motor as required. The prior art cover was also attached to the spool via a connection means located approximately mid-length of the cover such that, during deploying and harvesting of the cover at least two, and preferrably three workmen were required. The improvements of the instant invention allows manipulation of the reel and cover by an individual operator in a timely and labor saving manner.

Referring to FIGS. 4–6, a particular advantage of the thermal cover 40 for use in ski jumps and luge, bobsled and toboggan runs may be appreciated. The flexibility of cover 40 allows conformation to lengthwise and sidewise curvatures of the jumps and runs, with the length of cover 40 being variable according to the length of the surface which is to be covered. As seen in FIG. 4, one or more reels may be provided at the facility in order to cover the packed snow surface of the ski jump and/or landing area during non-use. For instance, rain, heavy snow, or the sun could effect the surfaces 62 in a detrimental manner. Surfaces 62 are preferrably packed snow, as opposed to a powdery or ice surface, both conditions being dangerous in the sport of ski jumping. An icy surface, while not allowing control of the skis also presents a dangerously hard surface upon which to land in case of a spill or other accident by the skier. A snow surface which is too powdery also prevents the proper control of the skis such that accidents are likely to occur. By use of the cover of the instant invention, the packed areas of take-off and landing may be preserved, or at least protected from needing a major overhaul, in that any rain or snow accumulating on the top surface of the cover may be melted, as by forced hot air or the heat of the sun and will flow away from the usable area by gravity. Due to the flexibility of cover 40, the ski jump surface may be totally covered by drooping the edges and free end of the cover 40 totally over the ski jump surface, while the landing surface may be further protected by the edges of the cover 40 extending past and generally conforming to the edges of the landing area to aid in the prevention of rain and subsequently formed ice from deteriorating such a surface.

In FIGS. 5 and 6, the flexibility and adaptability of the cover to runs for a luge, bobsled, or toboggan are disclosed. The length of the cover is adjustable to the length of the run by connecting sections 41 of the cover 40 in series. A preferred attachment means for such length adjustment of the cover is a male/female VELCRO strip arrangement as will be appreciated further from the remaining drawings.

Figure 7:
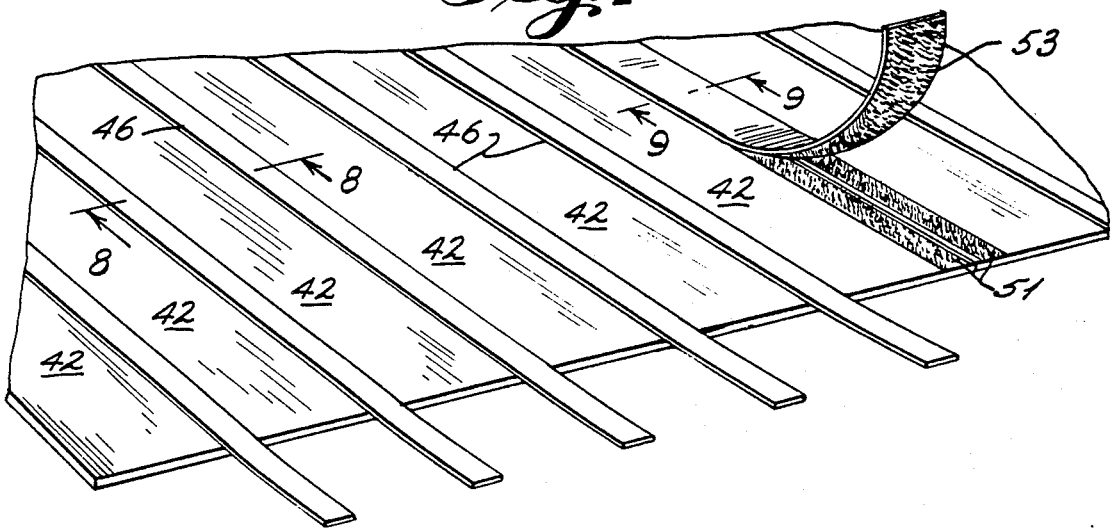
FIG. 7 is a partial isometric view illustrating edge-to-edge interconnection of sections of the insulative cover.
Figure 9:
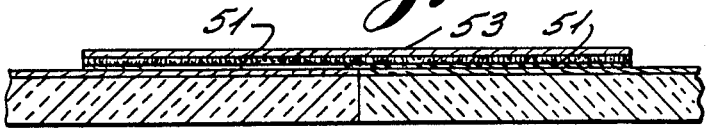
Figure 11:
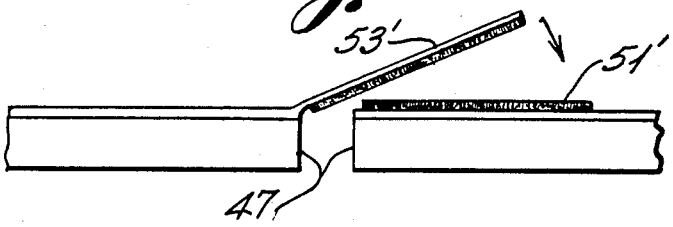
FIG. 11 is a partial side elevation illustrating an alternative embodiment for attaching sections of the cover edge-to-edge.

FIGS. 7, 9, 11, and 12 illustrate various VELCRO edge-to-edge attachments for sections of the cover, as when it is desired to expand the width of the cover over the surface of an ice rink. In FIGS. 7 and 9, a separate VELCRO strip 53 brings VELCRO strips 51 attached to the top surfaces of two adjacent sections of the cover in order to connect the sections edge-to-edge. An alternative embodiment for edge-to-edge attachment of the sections of the cover is illustrated in FIG. 11, in which VELCRO strip 53' is pivotal on one edge of the section such that it may bridge the edges 47 of adjacent sections and mate with VELCRO strip 51' attached to the opposite edge of a corresponding section.

Figure 12:
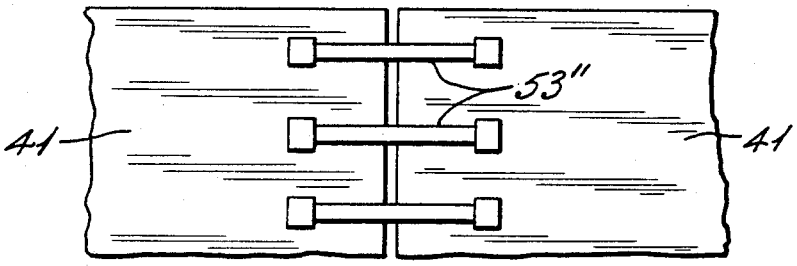
FIG. 12 is a partial top plan view illustrating an alternative embodiment for connecting sheets edge-to-edge.

In FIG. 12, bridging strips 53' of VELCRO are seen to be perpendicular to the edges of adjacent cover sections 41 and may be pivotally attached to one of the sections (as in FIG. 11) or may be separate bridger strips (as in FIG. 7) for mating with corresponding small squares of VELCRO attached to the tops of the sections along the edges.

Figure 13:
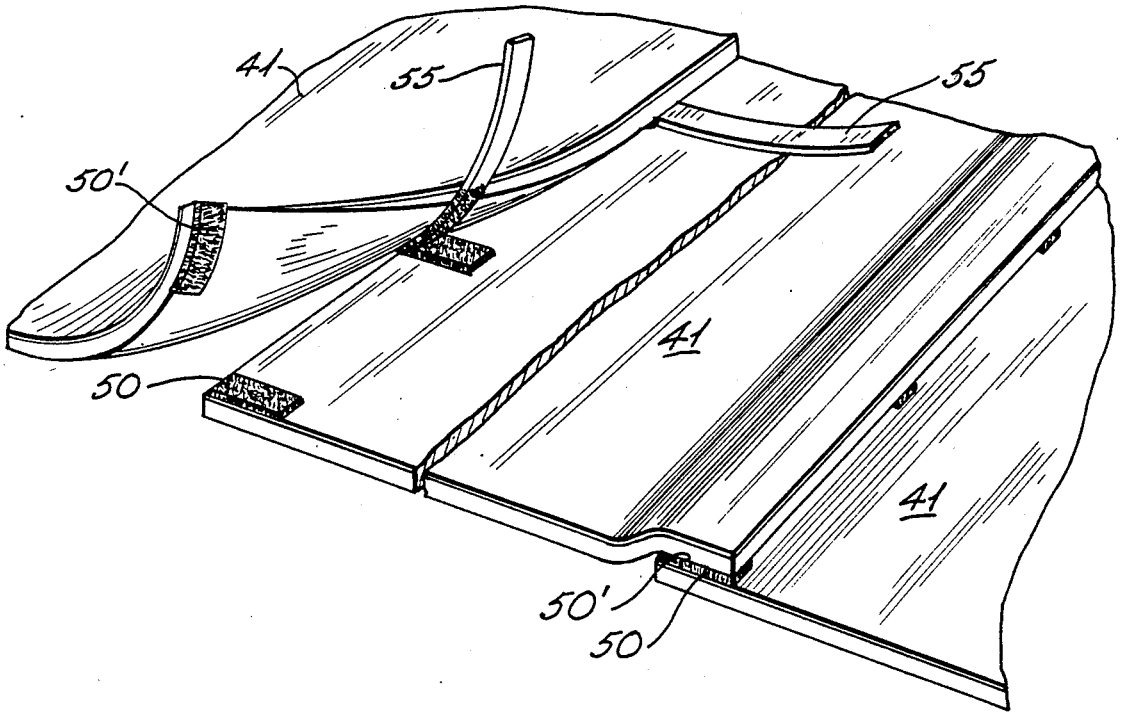
FIG. 13 is a partial side elevation illustrating one manner in which two sections are detachably connected end-to-end.

FIG. 13 generally illustrates the end-to-end connection means for sections 41 of the cover 40. At one end of section 41 VELCRO strips 50 are attached to the top surface, and mating strips 50' are attached at the other end to the bottom surface. In mounting an initial section 41 upon the reel 10, the bottom VELCRO strips 50 of FIG. 13 are engageable with mating strips 27 (FIG. 1) on the spool 11 of the reel. By extending VELCRO strips 50' past the end of cover section 41 (as in FIG. 13), the protruding portions 55 may be used as guide handles by an operator who is remote from the reel. This feature is particularly advantageous when the length of a section 41 may range in length up to approximately 200 ft. and, due to the flexibility of the cover material, it may be necessary to guide the strip 41 in a straight line when covering an ice surface. Further, such provision for guiding handles 55 allows sideways adjustment of the cover section during reeling to overcome the previously described problem of bunching-up of an edge of the cover with the side flanges or end plates 12, 13 of spool 11.

Figure 8:
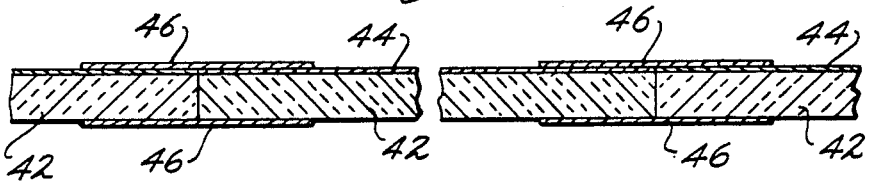
FIGS. 8 and 9, respectively, are cross-sections as generally viewed in the direction of arrows 8—8 and 9—9 of FIG. 7.
Figure 10:
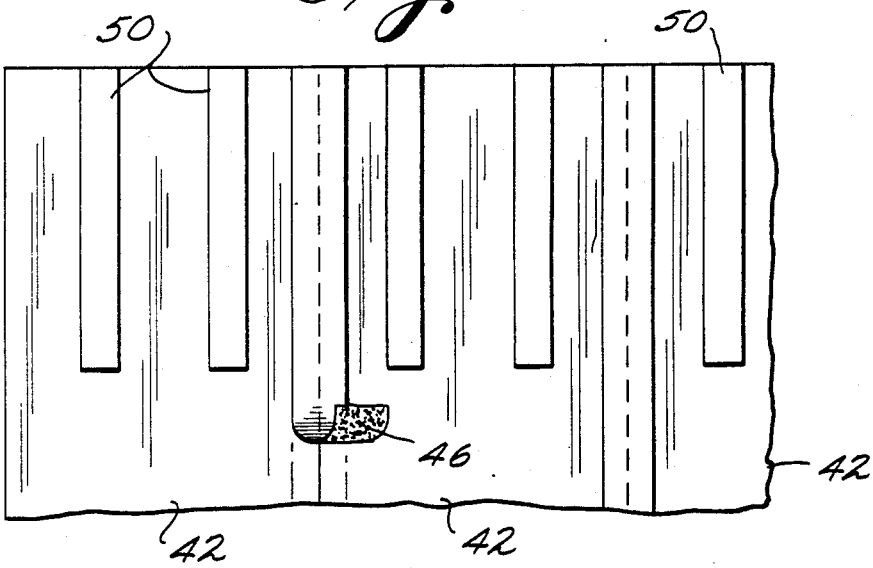
FIG. 10 is a partial, bottom plan view of an end of the thermal cover and illustrates a means of attachment of the cover to the spool of the reel.

The regulation American ice rink has a width of 85 ft. and length of 200 ft., and it has been found advantageous to cover the ice surface thereof a quarter-width at a time. Accordingly, it is necessary to provide each section of the cover with a width of generally 21.25–22 ft., according to whether the edges are to be overlapped or abutted. Since the insulative material used in the cover is available in widths of approximately 5–6 ft., it is necessary to interconnect several subsections 42 of the cover to achieve a quarter-width, as illustrated in FIGS. 7, 8, and 10. Additional strips 46 of scrim material 44 (which forms the top surface of the cover), provide the interconnection of subsections 42. Several of the interconnecting strips 46 may be extended to provide guiding handles, as seen in FIG. 7, in lieu of handles 55 of FIG. 13.

The procedure involved in applying the thermal insulative cover to an ice rink surface is as follows. Reel 10 has a series-connected, multi-section cover wound thereupon and is rolled from a storage location to a position on or adjacent the ice surface at one end of the rink. Guiding of the reel 10 into the position for application of the cover 40 is facilitated by handles 31. A portable radio transmitter 29 (FIGS. 2, 3) may be hand-held or clipped onto the belt of the operator for controlling reeling and unreeling motor 22 via radio receiver 28. The reel 10 is oriented with its axis perpendicular to the long dimension of the rink surface and may be secured in this position by engaging ice brakes 30. At this time, the operator may use transmitter 29 to unreel cover 40. With the transmitter clipped onto the belt of the operator within easy reach, both hands of the operator are free to grip handles 46 (FIG. 7) or 55 (FIG. 13) and guide the cover as it slides along the ice surface. Having traversed the full length of the ice rink with one section or a series of sections of the cover 40, the deployed portion of cover 40 may be detached from the remaining cover portion, and reel 10 may be repositioned to allow deployment onto the adjoining quarter-width of the rink.

Of course, a reverse operation is used in the harvesting of the cover from the surface of the ice rink, and it may be appreciated that a single operator is able to deploy and harvest the cover in an expeditious manner. For instance, the standard American ice rink may be totally covered or uncovered in less than 15 minutes. Each quarter of the cover requires about 1 minute and 20 seconds to deploy or harvest, with the remaining portion of the 15 minutes involving movement of the reel. In order to aid the operator in properly attaching the first section of cover 40 to spool 11, VELCRO strips 27 are provided with discontinuities 27' (FIG. 1) in their surroundment of spool 11. These breaks 27' ensure proper alignment of the first section on spool 11.

Since it is sometimes necessary for the operator to manipulate portions of the cover which are raised from the ice surface, as when overlapping section edges or attaching a section to the reel, the weight of the cover material becomes a critical factor. A preferred material used in fabrication of this cover comprises closed cell, cross-linked foamed polymeric plastic suited for use as a thermal barrier, with a polyethylene scrim 44 bonded to the top surface thereof to enhance the tensile strength of the cover. The cover has a density of substantially 4 pounds/ft$^3$, a thickness of substantially $\frac{1}{8}$ inch, and a sheer strength ranging from 5 lbs. to 7 lbs. per square inch. These properties are critical in order to optimize weight reduction while providing cost conscious heat rejection. The preferred material displays the physical characteristics of remaining flexible and non-brittle at ice temperatures, i.e., on the order of 10° to 25° F., displays a low to negligible degree of water absorption, has a low to negligible permeability to water vapor, displays a low rate of thermal conductivity, and has sufficient physical strength to withstand the stresses imposed during deployment and harvesting thereof. The heat transfer mechanisms active adjacent an ice surface are well described in the above mentioned U.S. Pat. No. 4,281,802.

For today's energy conscious society, it should be noted that use of the thermal barrier device can mean the difference between an ice rink facility staying in or going out of business. The U.S. Department of Commerce, Office of Energy-Related Inventions, has estimated annual savings of up to 50% when using the cover on ice surfaces of typical arenas during non-use hours. In actual testing of a prototype at the Cambria County War Memorial arena in Johnstown, Pa., savings were realized of 54% in electrical costs (i.e., for compressors) and 23% in heating fuel costs.

It should also be noted that numerous arenas are used for other activities in addition to ice skating and that it is necessary to cover the ice surface during use of the facility for concerts, trade shows, or the like. In this regard, the above-disclosed VELCRO connectors maintain the position of the cover on the surface of the ice when a portable floor is being applied to or removed from the cover for these other activities. As a safety feature, the top surface of the improved cover is flame retardant in order to avoid noxious fumes and fires as may occur from a carelessly discarded cigarette or match. Such a safety feature is extremely desirable when an ice rink facility is used for concerts, trade shows, and the like. A suitable, flame-retardant scrim material is LORATEX® 450 FR, from the Loretex Corp.

The following claims are intended to cover all of the generic and specific features of the invention herein described, and all statements of the scope of the invention which, as a matter of language, might be said to fall therebetween.

What is claimed is:

1. In a thermal barrier device for reducing heat transfer to and from an exposed ice surface and comprising a flexible, heat insulative cover deployable onto and harvestable from said ice surface in combination with a reel means for unwinding and winding of said cover, respectively, during the deploying and harvesting thereof, the improvement comprising:

plural sections of said cover, each of said sections having a length terminating in opposite ends, a width terminating in opposite edges, and a thickness, and means for connecting to an endwise adjacent section to form a series of sections;

means for connecting an end of a terminal section of said series to said reel means;

said reel means being mounted on a vehicle repositionable relative to said ice surface such that edgewise adjacent portions are deployable and harvestable in accordance with repositioning of said reel means;

handle means, attached to said cover, for grasping by an individual in order to guide said flexible cover during said unwinding and winding;

means for driving a spool of said reel means in forward and reverse by remote control to accomplish said unwinding and winding; and wherein said reel means is operable from a remote location in order that said individual can accomplish said deploying and harvesting.

2. An improvement as in claim 1, wherein said means for connecting a terminal section end to said reel means comprises:

cooperable connectors attached to said spool and to said terminal section end, such that said connecting is detachable, at least two strips of velcro material each attached to and about a portion of an external diameter of said spool to provide a gap between ends of each strip, and velcro material at said terminal section end such that said detachable connecting is provided; and said gap of each strip providing means for aiding aligning of said terminal section end on said spool during said connecting.

3. An improvement as in claim 1, and further comprising:

velcro edge connectors along at least a portion of each of said edgewise adjacent sections and means for attaching said edgewise adjacent sections together via said velcro edge connectors.

4. An improvement as in claim 1, wherein said reel means further comprises:

ice brake means, on said vehicle, for engaging said ice surface and preventing movement of said vehicle relative to said ice surface during said deploying and harvesting of said cover.

5. An improvement as in claim 1, wherein said handle means comprises:

said means for connecting said series of sections endwise.

6. An improvement as in claim 1 and further comprising:

radio receiver means for controlling said driving means, and portable radio transmitter means for controlling said radio receiver means, wherein said spool driving means is controllable via said receiver means by controlling said transmitter means at a location remote from said spool in order to facilitate said deploying and harvesting by an operator.

7. An improvement as in claim 1, wherein said cover has a bottom surface engageable with said ice surface and a top surface and wherein:

said bottom surface comprises a cross-linked, closed cell foamed plastic material; and said top surface comprises a polyethylene reinforcing scrim bonded to said foamed plastic material;

wherein said cover has a low permeability to water vapor and is thermal insulative.

8. An improvement as in claim 7, wherein said cover further comprises:

material having a density of substantially 4 lbs./ft$^3$, a thickness of substantially $\frac{1}{8}$ inch, and a shear strength ranging from about 5.0 lbs/in$^2$ to 7.0 lbs/in$^2$.

9. An improvement as in claim 1, wherein each of said sections comprises:

subsections of material butted together along edges thereof and retained in abutting relation by polyethelene strips bonded to top and bottom surfaces of adjacent subsections.

10. An improvement as in claim 9, and said handle means comprising: protrusion of at least two of said strips from a section of said cover.

* * * * *